US010604293B2

(12) United States Patent
Barry

(10) Patent No.: US 10,604,293 B2
(45) Date of Patent: Mar. 31, 2020

(54) SYSTEMS AND METHODS OF GENERATING AND DISPOSING LABELS ON CONTAINERS

(71) Applicant: Safeway Inc., Pleasanton, CA (US)

(72) Inventor: Mike Barry, Pleasanton, CA (US)

(73) Assignee: Safeway Inc., Pleasanton, CA (US)

( * ) Notice: Subject to any disclaimer, the term of this patent is extended or adjusted under 35 U.S.C. 154(b) by 283 days.

(21) Appl. No.: 15/263,976

(22) Filed: Sep. 13, 2016

(65) Prior Publication Data

US 2016/0376051 A1 Dec. 29, 2016

Related U.S. Application Data

(63) Continuation of application No. 14/465,708, filed on Aug. 21, 2014, now Pat. No. 9,524,659.

(51) Int. Cl.

| | |
|---|---|
| ***B65C 3/08*** | (2006.01) |
| ***G09F 3/00*** | (2006.01) |
| ***B65C 3/14*** | (2006.01) |
| ***B65C 9/00*** | (2006.01) |
| ***G09F 3/02*** | (2006.01) |
| ***G09F 3/10*** | (2006.01) |
| ***B65C 3/16*** | (2006.01) |

(52) U.S. Cl.

CPC ..... *B65C 3/08* (2013.01); *B65C 3/14* (2013.01); *B65C 3/16* (2013.01); *B65C 9/0006* (2013.01); *G09F 3/02* (2013.01); *G09F 3/0288* (2013.01); *G09F 3/10* (2013.01); *G09F 3/0289* (2013.01); *G09F 2003/023* (2013.01); *G09F 2003/0272* (2013.01)

(58) Field of Classification Search

CPC ..... G09F 2003/0272; G09F 2003/0273; G09F 2003/0275; G09F 3/0289; G09F 3/0288

See application file for complete search history.

(56) References Cited

U.S. PATENT DOCUMENTS 1,306,691 A 6/1919 Goetz
1,974,401 A 9/1934 Miller
(Continued)

FOREIGN PATENT DOCUMENTS

JP 3154715 U 10/2009

OTHER PUBLICATIONS

Office Action dated Jan. 20, 2016, 12 pages, U.S. Appl. No. 14/465,708, filed Aug. 21, 2014.

(Continued)

*Primary Examiner* — Scott W Dodds

(74) *Attorney, Agent, or Firm* — Conley Rose, P.C.; Rodney B. Carroll

(57) ABSTRACT

Systems and methods disclosed herein relate to a label and a method of application of the label on a container that both protects confidential information and functions to allow for the placement of auxiliary labels even if an overall length of a label exceeds the perimeter of the container to which it is applied. The auxiliary labels are disposed in a fanned fashion, attached to a primary label portion by, for example, a micro perforation line, and where the auxiliary labels are separated from each other by micro perforation lines and where the adhesive back of each pair of auxiliary labels are attached to each other in order to form a plurality of protrusions.

19 Claims, 10 Drawing Sheets

(56) References Cited

U.S. PATENT DOCUMENTS

| | | | | | |
|---|---|---|---|---|---|
| 2,194,220 | A | * | 3/1940 | Elder | B65D 75/54 116/DIG. 14 |
| 3,994,089 | A | * | 11/1976 | Schwartz | G09F 3/0289 40/310 |
| 4,188,250 | A | * | 2/1980 | Grass | B31D 1/021 156/253 |
| 4,880,964 | A | * | 11/1989 | Donahue | G06K 19/02 235/488 |
| 5,076,611 | A | | 12/1991 | Bouton | |
| 5,172,936 | A | * | 12/1992 | Sullivan | G09F 3/04 283/81 |
| 5,259,906 | A | * | 11/1993 | Poplawski | B42D 15/006 156/247 |
| 5,366,249 | A | * | 11/1994 | Diemert | G09F 3/0288 283/80 |
| 5,484,167 | A | | 1/1996 | Donaldson et al. | |
| 6,860,513 | B2 | | 3/2005 | Kaufman | |
| 6,941,689 | B1 | | 9/2005 | Seidl | |
| 7,077,435 | B1 | | 7/2006 | Cowan | |
| 7,398,999 | B2 | | 7/2008 | Kaufman | |
| 7,740,411 | B2 | | 6/2010 | Kaufman | |
| 7,926,851 | B2 | | 4/2011 | Kaufman | |
| 2004/0075272 | A1 | | 4/2004 | Kaufman | |
| 2008/0301982 | A1 | | 12/2008 | Kaufman | |
| 2008/0303265 | A1 | | 12/2008 | Kaufman | |
| 2010/0295916 | A1 | | 11/2010 | Kaufman | |
| 2016/0055773 | A1 | | 2/2016 | Barry | |

OTHER PUBLICATIONS

Notice of Allowance dated Aug. 16, 2016 (5 pages), U.S. Appl. No. 14/465,708, filed Aug. 21, 2014.

* cited by examiner

SYSTEMS AND METHODS OF GENERATING AND DISPOSING LABELS ON CONTAINERS

CROSS-REFERENCE TO RELATED APPLICATIONS

This application is a continuation of and claims priority to U.S. patent application Ser. No. 14/465,708 filed Aug. 21, 2014, published as U.S. Patent Application Publication No. US 2016/0055773 A1, and entitled "Systems and Methods of Generating and Disposing Labels on Containers," which application is incorporated by reference herein in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Various medications may be prescribed or recommended to patients for different health conditions. Patients may fill these prescriptions or buy this medication from different retail or online vendors and the medications may be dispensed in containers that have customized labels for each customer.

SUMMARY

In an embodiment, a method of applying a label to a container comprising: removing a label from a backing, wherein the label comprises a plurality of portions separated by micro perforations, wherein each portion comprises a first side removably attached to the backing by an adhesive disposed on at least some of the first side and a second side opposite the first side; disposing a first portion of the plurality of portions of the label on an outer surface of a container; disposing a second portion and a third portion of the plurality of portions, wherein the second portion and the third portion are disposed in a first folded configuration, and wherein the second portion and the first portion are separated by a micro perforation.

In an embodiment, a label disposed on a container comprising: a plurality of sections each comprising a first side and a second side, wherein the plurality of sections are separated by micro perforations and extend around the container for less than the perimeter of the container, wherein each section of the plurality of sections comprises a border that separates each section from adjacent sections, wherein the first side of each of the plurality of sections comprises a plurality of information, wherein an adhesive is disposed on at least some of the second side of each of the plurality of sections; a primary section of the plurality of sections comprising at least one micro perforated side, wherein the primary section comprises at least one removable portion comprising a first end, a second end, and a middle portion between the first end and the second end; and at least some of the plurality of sections other than the primary section disposed in a folded arrangement wherein the second side of a first portion is disposed in contact with the second side of a second portion, wherein the first and the second portions are adjacent and separated by the micro perforations.

In an embodiment, a label disposed on a container comprising: a plurality of sections each comprising a first side and a second side, wherein the plurality of sections are separated by micro perforations and extend around a container for less than the perimeter of the container, wherein the label length is greater than the perimeter of the container, wherein each section of the plurality of sections comprises a border that separates each section from adjacent sections, wherein the first side of each of the plurality of sections comprises a plurality of information, wherein an adhesive is disposed on at least some of the second side of each of the plurality of sections, and wherein the adhesive is not disposed in the borders; a primary section of the plurality of sections comprising three die-cut sides and one micro perforated side, wherein the primary section comprises at least one removable portion comprising a first end, a second end, and a middle portion between the first end and the second end, wherein the removable portion does not comprise any of the three die-cut sides and the micro perforated side; and at least some of the plurality of sections other than the primary section are disposed in a folded arrangement, wherein the second side of a first portion is disposed in contact with the second side of a second portion, wherein the first and the second portions are adjacent and separated by the micro perforations, wherein the second side of a third portion is disposed in contact with the second side of a fourth portion, wherein the third portion is adjacent to the second portion and the fourth portion and the second and third portions are separated by the micro perforations.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

Pharmacists fill thousands of prescriptions each week, and each prescription may need to be individually labeled. The label information may comprise information on a primary label such as the prescribing doctor's contact information, patient's contact information, medicine description, medicine dosage, medicine delivery instructions, and number of refills left, if any. There may be additional information for various prescriptions including warnings, indications, and other information that a person taking the medication may find desirable to know or that may be required by law. This additional information may be provided on what may be referred to as auxiliary labels. Conventionally, the primary label and auxiliary labels may be printed on a label attached to a backing, and a separate adhesive, for example, a piece of tape, may be applied to the front of the label to remove it from the backing and place it on the container. In this example, the patient information remains on the container and if there are more auxiliary labels than the perimeter of the container can display, it may take additional work on behalf of the pharmacist or pharmacy staff to try to remove and rearrange the auxiliary labels so that they all fit on the container and are legible.

Figure 1:
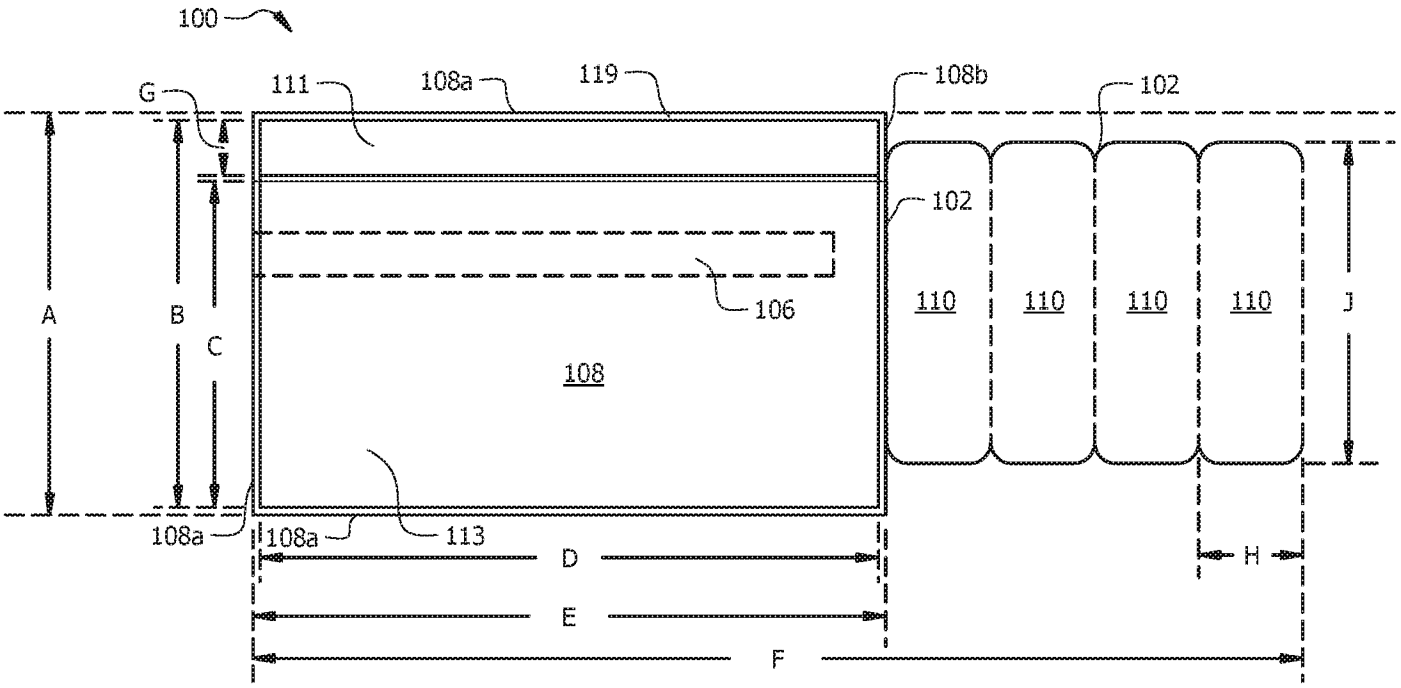
FIG. 1 is an illustration of a label that may be manufactured and employed according to certain embodiments of the present disclosure.

In the systems and methods disclosed herein, a label is generated and used. This label improves both the patient's and the pharmacist's experiences. For example, the label (1) provides patients with additional privacy options and (2) provides pharmacists with a label of an overall length that exceeds the perimeter of the container to which it is applied. As discussed herein, the term "length" may be used to refer to a length of a label which describes the size of the label in the direction of the information on the primary label as indicated in FIG. 1. The patient privacy options discussed herein may be desirable in the event that a patient does not want their personal information disseminated from an old medication bottle, or if the patient may not want to advertise that they are taking a particular medication. The option of having a label of an overall length which exceeds the perimeter of the container to which it is applied saves both time and expense and makes it easier for the label to be applied and for the patient to access the auxiliary labels since the labels are disposed in an orderly but condensed fashion instead of applied, usually by hand, wherever they may fit on the limited space of the container's outer surface (e.g., the perimeter or circumference).

A label may be generated according to certain embodiments of the present disclosure by inkjet printing, thermal printing, or other printing methods as appropriate and available. The label may comprise a main or primary portion that contains information regarding the patient, medicine, and doctor, and a plurality of auxiliary portions that comprise warnings or other information related to the prescribed medication. The primary label and each auxiliary label may be separated from each other using micro perforations. As used herein, the term "micro perforations" may be used to describe a feature between portions of a label that comprises a plurality of small holes or incisions of uniform or varying sizes, including repeated patterns of incisions of various sizes. The micro perforations may be employed as discussed herein in order to ease the disposal of the label on a container and to ensure that the warnings are properly displayed. It is appreciated that the Food and Drug Administration may modify the warnings for different drugs during the lifetime of those drugs, and in some embodiments the label discussed herein may be used without altering the rest of the packaging even if additional warnings are added.

In an embodiment, the primary label may comprise a removable portion. This portion may comprise one of the edges of the primary label, a corner of the primary label, or a portion in the middle of the primary label that is not adjacent to any of the edges. This removable portion may comprise the patient's information, because the patient may not want to keep their name on the prescription after they take possession of the medication. In another embodiment, for example, if a patient is required by law to keep their information attached to the prescription, for example, if the medicine is a controlled substance, is not prescribable interstate, or is not a valid prescription in another state, the patient may want or need to keep their information associated with the medication until the prescription is finished or otherwise no longer needed. In that embodiment, the patient's information may be removed when the container is thrown out. The removable portion may, as discussed in detail below, comprise two end portions and a middle portion, some or all of which may have adhesive located as to enable removal of the portion. The end portions may range in size based upon the size of the removable portion. In some embodiments, the removable portion may comprise a border and an interior portion, at least one of which may comprise adhesive.

Conventionally, if a label's length exceeds the perimeter of the container, the auxiliary labels may be removed individually from the backing or otherwise repositioned. This removal may be done by hand and may result in the auxiliary labels tearing or being otherwise illegible once they are applied to the container. Using the systems and methods discussed herein, auxiliary labels may be folded against each other in a fanned fashion in order to save space and present a clean, orderly, compliant label on a container.

Figure 2:
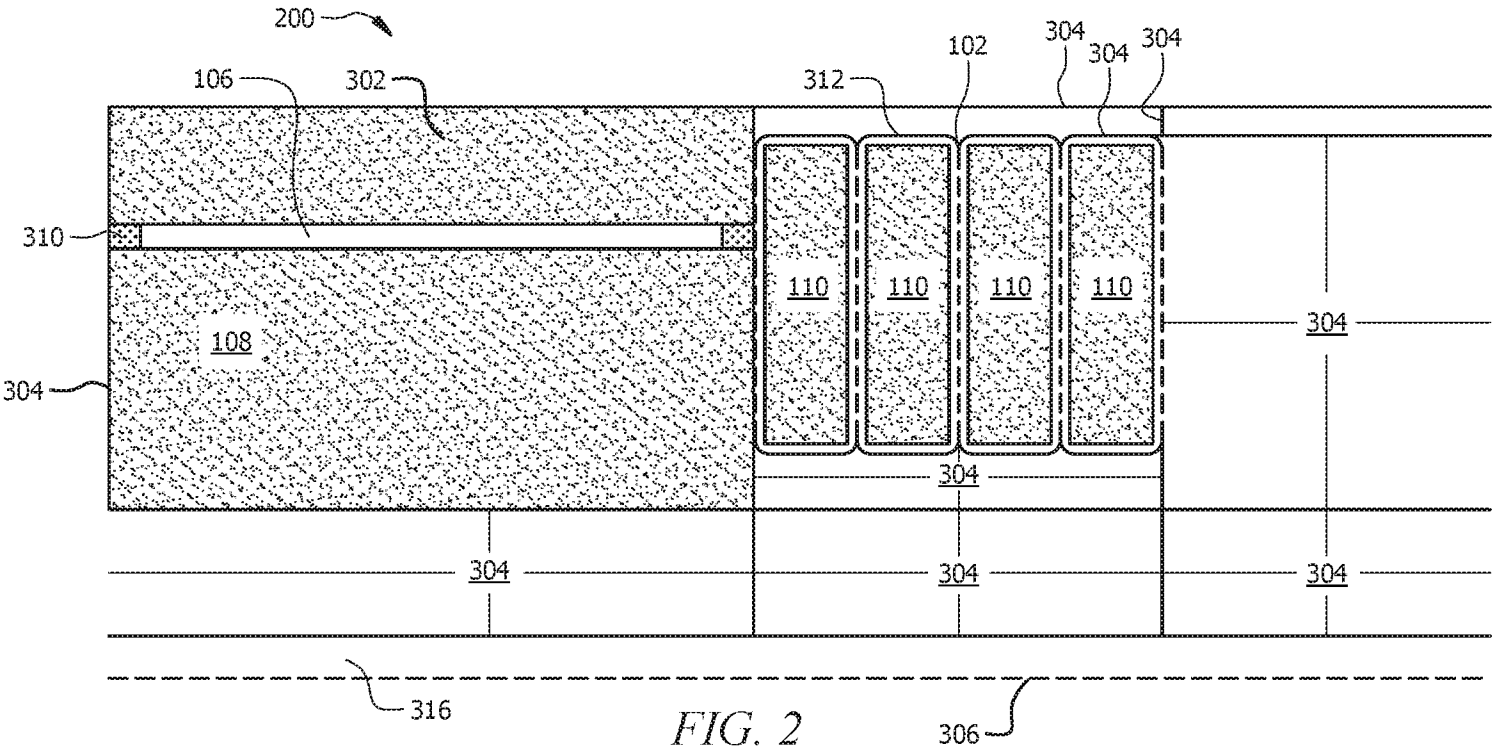
FIG. 2 is an illustration of a second side of a label according to certain embodiments of the present disclosure.
Figure 3:
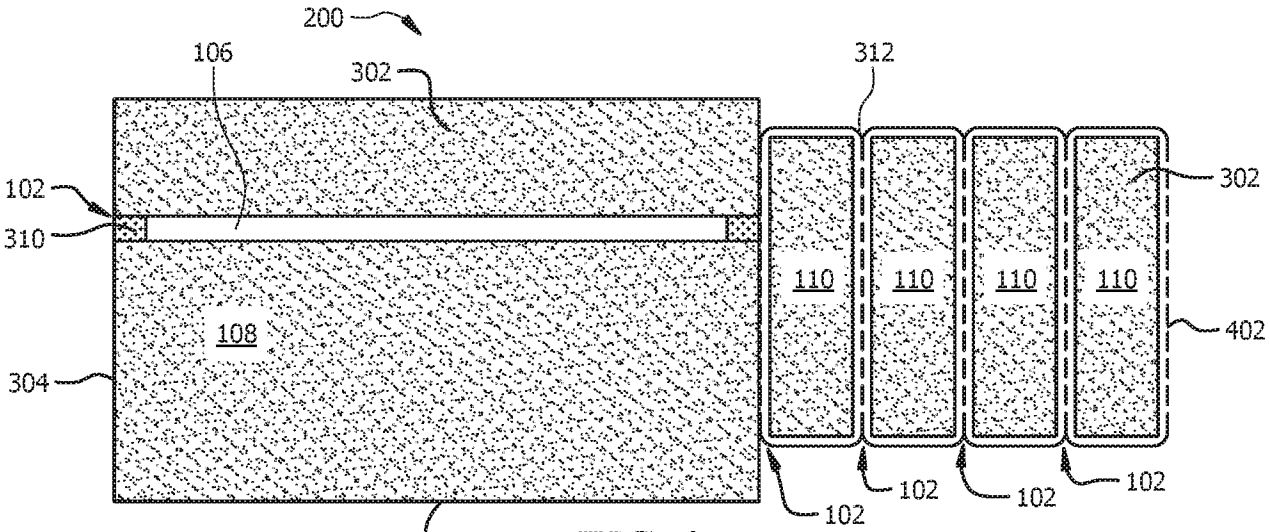
FIG. 3 is an alternate illustration of the back of the label according to certain embodiments of the present disclosure.
Figure 4:
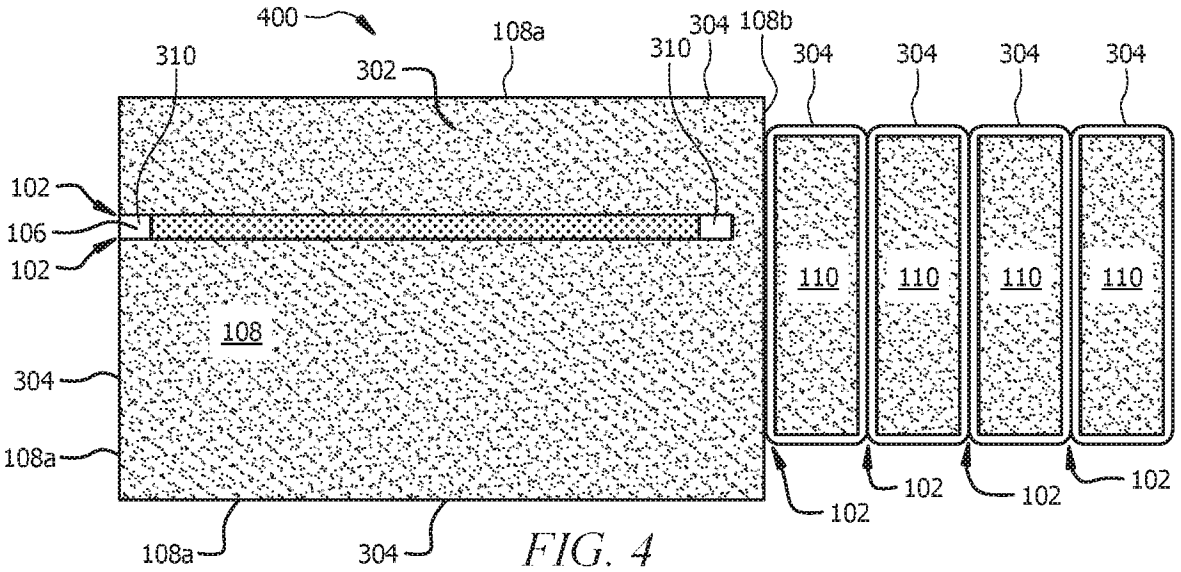
FIG. 4 is an alternate illustration of the back of the label according to certain embodiments of the present disclosure.

FIG. 1 is an illustration of a label 100 that may be manufactured and employed according to certain embodiments of the present disclosure. The label 100 illustrated in FIG. 1 comprises a printed first side and an adhesive second side. The printed first side is shown in FIG. 1 and the adhesive second side is illustrated in FIGS. 2-4. It is appreciated that FIG. 1 is the printed side even though FIG. 1 does not illustrate the printing. The label 100 has an overall height A and a secondary height B, which does not include a border 119 that may extend around all four sides (108*a* and 108*b*) of a primary label 108. The sides 108*a* may have been die-cut or otherwise formed and the side 108*b* may be separated from an auxiliary label 110 by a plurality of micro perforations 102, which may also separate subsequent auxiliary labels 110 from each other. The primary label 108 may comprise multiple sections including the first section 111, where G is the height of the section 111, that may be used to display a brand name or other information related to the pharmacy that issues the prescription or the doctor who prescribed the medication. A second section 113 of the primary label 108 may have a height C and may display additional information such as the patient's name and/or contact information, as well as information about the medication including the dosage, scheduling/timing, and refill allotment. A length of the primary label 108 is indicated by E, and the length of the primary label 108 without the border 119 is indicated by D. The label 100 in FIG. 1 may comprise one or more of the auxiliary labels 110 that may have a height of J and a length of H. The overall length F of the label 100 comprises the length E of the primary label 108, as well as the combined length of the plurality of auxiliary labels 110. While four auxiliary labels 110 are used for illustration purposes in FIG. 1, in different embodiments, for example, for different medications that are prescribed in different states or packaged by different pharmacies, there may be upwards of 10 auxiliary labels. In some embodiments, the overall length F exceeds the perimeter of the container that the label 100 is applied to, and the micro perforations 102 allow the entire label 100 to be placed on the container without the pharmacist or pharmacy staff having to manually remove the auxiliary labels 110. Typically, removing auxiliary labels by hand is difficult because auxiliary labels are conventionally not separated aside from possibly a slight score mark or indentation which can lead to tearing of the auxiliary label being removed, as well as damage to the surrounding labels. All of this manual effort takes time and money and is not desirable in a label-application including but not limited to a pharmacy.

FIG. 2 is an illustration of a second side of a label 200 that may be similar to the label 100 in FIG. 1. In this embodiment, the shading of adhesive 302 on primary label 108, auxiliary labels 110, and on the ends 310 of the removable portion 106 indicates where the adhesive 302 has been applied. A plurality of die-cut lines 304 indicate where the label 200 has been cut and/or sectioned, it is appreciated that these additional sections formed by the plurality of die-cut lines 304 on the label 200 may be used in various arrangements to form shapes of various geometries (triangle, circle, trapezoid, irregular, square, rectangle, and combinations thereof) in embodiments depending upon the prescription medication or other product being labeled.

It is also appreciated that the label 200 may be attached to backing 316 and that some or all of the additional sections formed by die-cut lines 304 may have adhesive 302 (not pictured here) applied to the second side of those pieces as well, and that 306 indicates where a bottom edge of the backing may end. In some embodiments, there may be an area of backing 316 on more than one side of the label 200, depending upon the size and shape of the labels used, as well as the end application. The labels discussed herein may be printed by inkjet, laser, thermal printing, or other printing methods as available in the art.

The label 200 in FIG. 2 illustrates the plurality of auxiliary sections 110 separated from each other and from the primary section 108 by the micro perforations 102. In one embodiment, there may be a region of adhesive 302 on the ends 310 of the removable portion 106. Each auxiliary portion 110 may also, in some embodiments, comprise a border region 312 that does not comprise the adhesive 302. In alternate embodiments, not pictured here, the border region 312 may comprise the adhesive 302 in addition to or instead of the region inside of the border region 312. In alternate embodiments, the adhesive 302 may be disposed in various patterns and configurations on the second side of the label 200 in order to facilitate label application and assembly as discussed below. In any of the disclosed embodiments, the adhesive 302 may be disposed in various patterns and arrangements in order to maximize the ease of use of the label 200 while still maintaining quality control and adhesion to the backing 316, the container (discussed below), and to other depositions of adhesive 302 on other parts of the label 200 also as discussed below.

FIG. 3 is an alternate illustration of the back of the label 200 in FIG. 2 without the backing 316 or additional die-cut sections defined by die-cut lines 304. FIG. 3 illustrates the back of the label 200 comprising adhesive 302 on the primary label 108 and the area within the border region 312 of the auxiliary sections 110. As discussed in FIG. 2, the removable portion 106 of the primary label 108 may comprise adhesive 302 on at least one end 310 or in some or part of the area in between the ends 310. In some embodiments, the removable portion 106 may have adhesive 302 applied in different configurations including in a border (not pictured) around the removable portion 106 or in an area inside a border (not pictured) around the removable portion 106 similar to the border region 312 around each of the auxiliary labels 110. It is appreciated that the primary label 108 and the auxiliary labels 110 may be referred to as sections or portions depending upon the embodiment. The number of auxiliary labels 110 employed in a particular label 200 may depend on the number of warnings, advisories, or other indications associated with a particular medication as required by the FDA or other regulatory bodies. Indication 402 in FIG. 3 illustrates that additional auxiliary labels 110 may be employed, and these labels may be attached to the illustrated label 200 and subsequent auxiliary labels 110 by micro perforations. In some embodiments, the plurality of auxiliary labels 110 may be identically sized, and in alternate embodiments the size of the auxiliary labels 110 may vary, or pairs of adjacent auxiliary labels 110 may be similarly sized.

FIG. 4 is an illustration of the back of a label 400 that may be similar to the label 200 discussed above in FIGS. 2 and 3. In FIG. 4, the adhesive 302 is disposed on the second side of the primary label 108 and the auxiliary labels 110 which are separated by micro perforations 102 as discussed above. The primary label 108 may comprise three die-cut lines 304 along sides 108*a* and one micro perforated 102 side 108*b*, as well as the removable portion 106. In this embodiment, the adhesive 302 is not disposed on the ends 310 of the removable portion 106 but rather in the middle of the removable portion 106 in between the ends 310.

Figure 5:
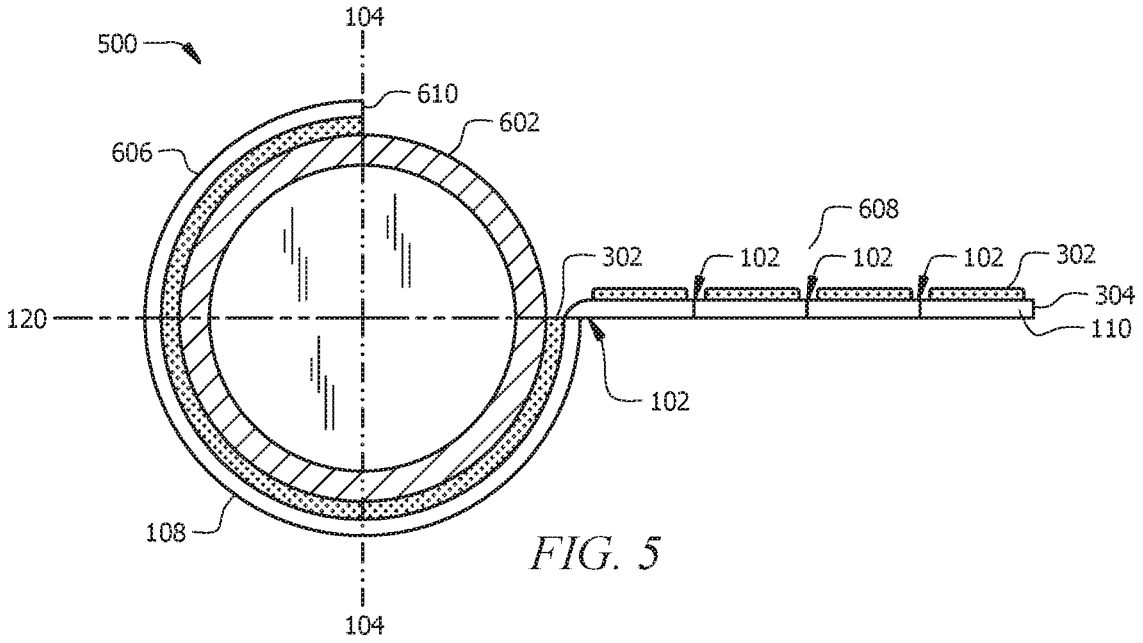
FIG. 5 is an illustration of a first step in a method of disposing a label on a container according to certain embodiments of the present disclosure.

FIG. 5 is an illustration of a first step in a method of disposing a label 500 on a container. The label 500 may be disposed manually, automatically by mechanical and/or thermal transfer means, or by a combination of manual and automatic methods. The label 500, which may be similar to the labels discussed in FIGS. 1-4, comprises a primary label 108, a first side 606 that may be similar to FIG. 1 and a second side 608 that comprises the adhesive 302. While example container 602 is provided here for illustration, the containers to which the label may be attached may be cylindrical, triangular, square, rectangular, as well as other known geometric shapes and irregular shapes including tubes.

Figure 9:
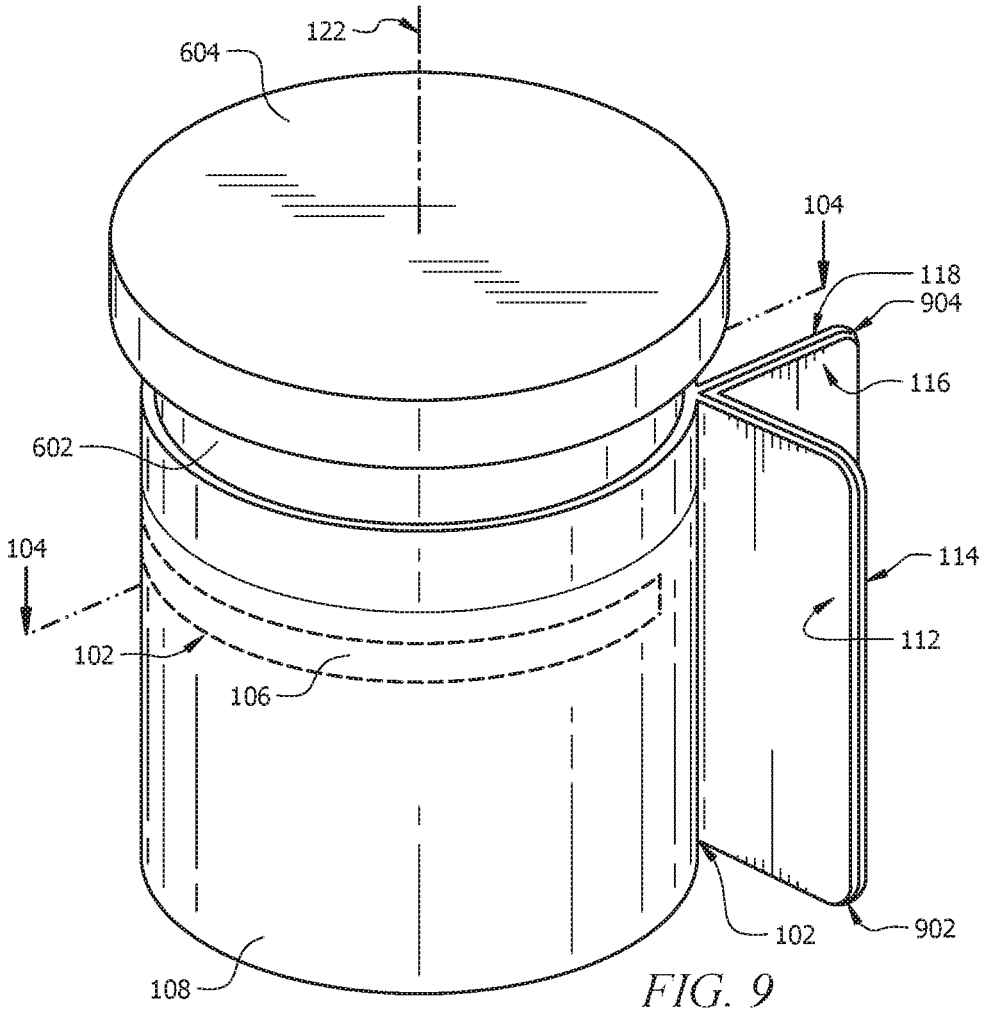
FIGS. 9 and 10 are isometric views of a label disposed on a container according to certain embodiments of the present disclosure.
Figure 10:
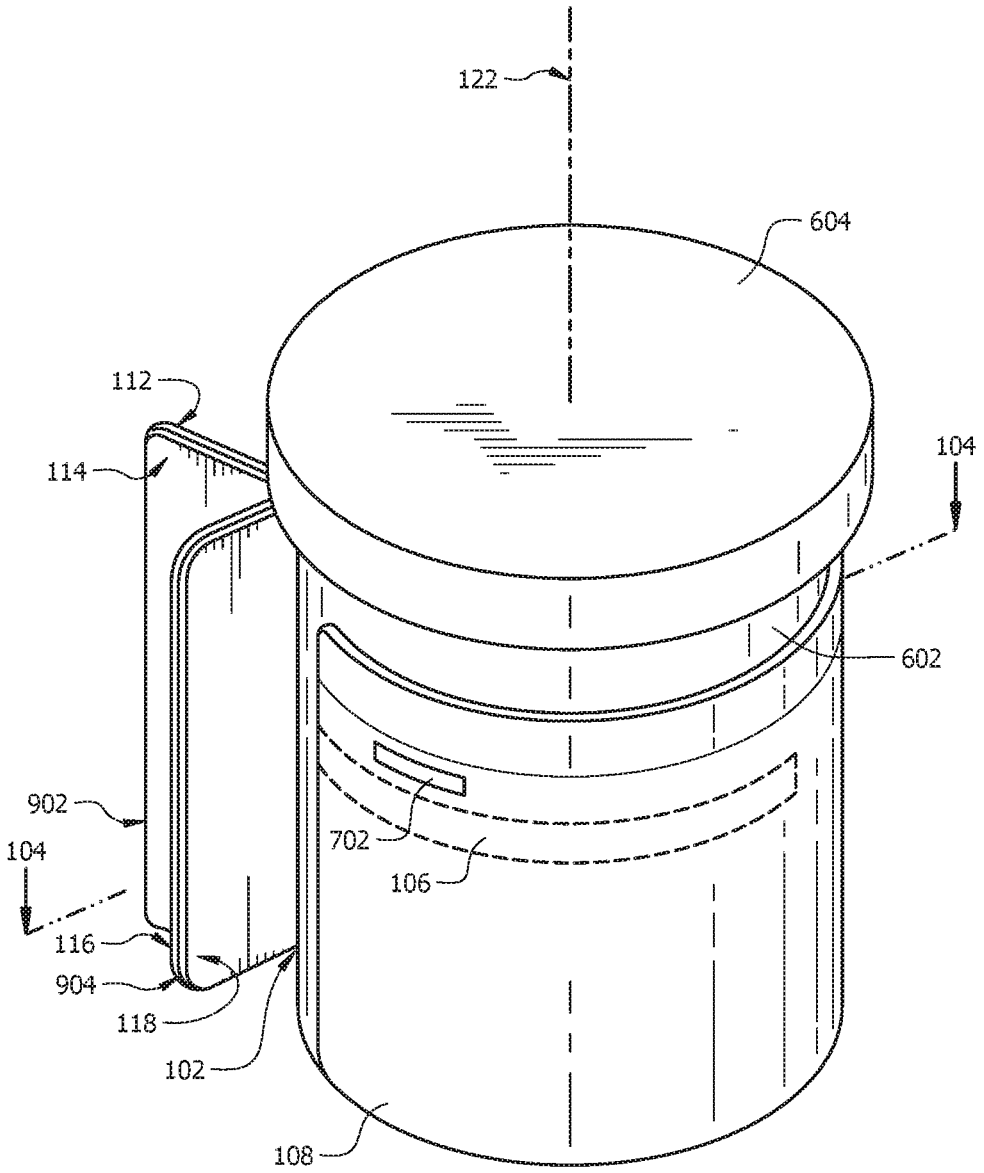

The container 602 may be defined by a first axis 104 perpendicular to the upright direction (not pictured) of the container 602, a second axis 120 that is perpendicular to first axis 104, and a third axis 122 not pictured here but discussed in at least FIGS. 9 and 10. The primary label 108 may be disposed on the container 602 with a lead edge 610 of the primary label 108 disposed perpendicular to first axis 104. In other embodiments, the lead edge 610 may be disposed in another position around the perimeter of container 602, and it is understood that different containers 602 may have different starting points for label application with the intention that the label is applied in a position where it will be legible/easily accessible to the patient.

Figure 6:
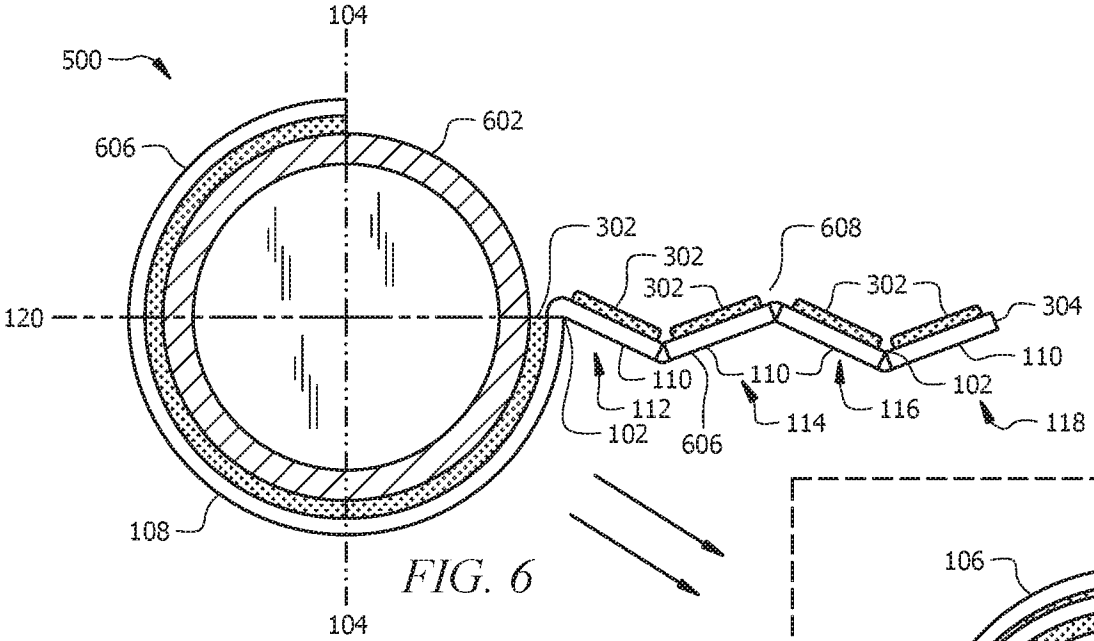
FIGS. 6 and 7 illustrate different stages in disposing a label on a container according to certain embodiments of the present disclosure.
Figure 7:
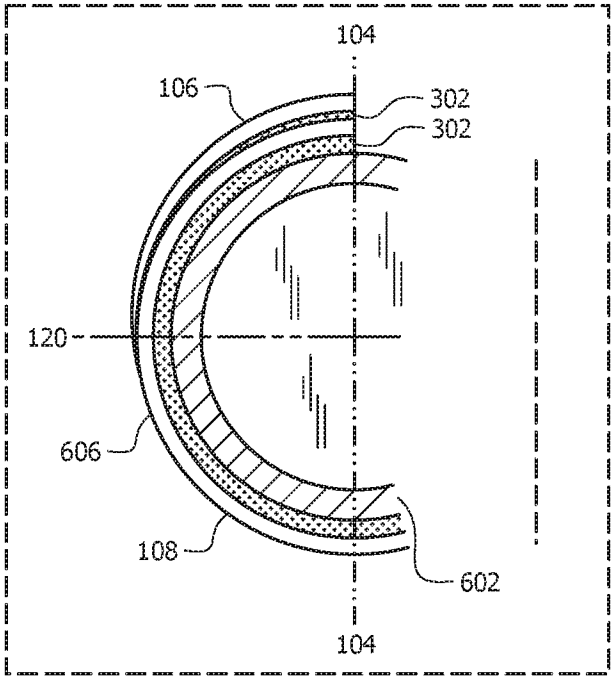

FIGS. 6 and 7 illustrate different stages in applying the label 500 to the container 602. In FIG. 6, the plurality of auxiliary labels 110 are engaged. The plurality of auxiliary labels 110 includes a first auxiliary label 112, a second auxiliary label 114, a third auxiliary label 116, and a fourth auxiliary label 118 that each comprise a first side 606 and a second side 608 that may comprise adhesive 302 in various configurations as discussed above. In FIG. 6, the first auxiliary label 112 and the second auxiliary label 114 are bent along the micro perforation 102 that separates first auxiliary label 112 from second auxiliary label 114 so that the second side 608 of each of first auxiliary label 112 and second auxiliary label 114 is tilted so that the second sides 608 are tilted towards each other. The third auxiliary label 116 and fourth auxiliary label 118 are angled similarly, with the second side 608 of each of third auxiliary label 116 and fourth auxiliary label 118 tilted towards each other.

FIG. 7 illustrates the removal of the removable portion 106 of the primary label 108. FIG. 7 is a partial illustration of the container 602 in FIG. 6, where the removable portion 106 of the primary label 108 is being removed. As indicated by the two adhesive 302 locations, the removable portion 106 may be separated from the primary label 108 on at least one of its four sides by a plurality of micro perforations 102. While the removable portion 106 is illustrated as an elongated rectangle herein, it may also take other shapes such as a circle, square, triangle, as well as combination and irregular geometries and may have adhesive 302 disposed in varying manners and patterns depending upon the geometry of the removable portion 106. FIG. 7 illustrates that when the removable portion 106 is removed, its adhesive 302 may also be removed in whole or in part but, as FIG. 7 is a cross-sectional view, the adhesive 302 is also shown on the container 602. The removable portion 106 may be located in any position on the primary label 108. In some embodiments, the removable portion 106 does not comprise any of the edges 108*a* or 108*b* from FIG. 1, and in other embodiments the removable portion 106 comprises at least one of the edges 108*a* or 108*b*. It is appreciated that, while the removable portion 106 may be removed after the label 500 is otherwise disposed, some customers may wait until the prescription is finished before removing it.

Figure 8:
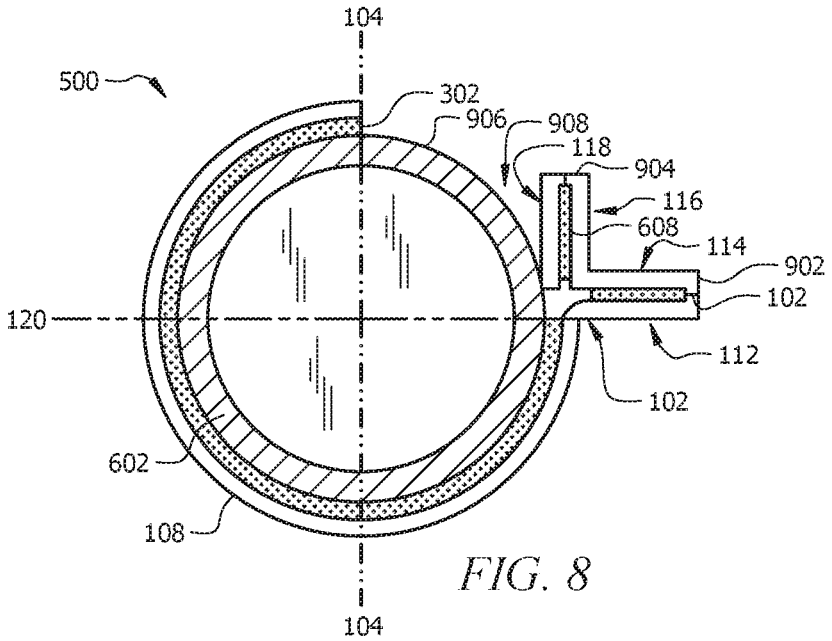
FIG. 8 is an illustration of a label disposed on a container according to certain embodiments of the present disclosure.

FIG. 8 is an illustration of a label 500 disposed on a container 602 according to certain embodiments of the present disclosure. In FIG. 8, the primary label 108 is disposed along the circumference of the container 602 with the adhesive 302 disposed on the outer circumference of the container 602. The label 500, including the primary label 108 and the auxiliary labels 112, 114, 116, and 118 are disposed in a folded or fanned configuration attached to the container 602 by the micro perforations 102 and the container 602 may then be ready to be delivered to the consumer or other receiving entity. As indicated by the start of the folding in FIG. 6, the first auxiliary label 112 and the second auxiliary label 114 have been folded to where the second sides 608 of each, which may comprise the adhesive 302, are folded against each other to form a first protrusion 902. This first protrusion 902 may extend outward from the container 602, for example, in about the direction of second axis 120 in a direction perpendicular to the surface of the container 602. The second side 608 of the third auxiliary label 116 is folded at the micro perforation separating it from the fourth auxiliary label 118 against the second side 608 of 118 to form a second protrusion 904. The second protrusion 904 may extend perpendicular to the first protrusion 902 and in a direction tangent to the circumference of the container 602. After the protrusions are formed, they may extend as indicated in FIG. 8, and they may alternatively be folded against each other flush or nearly flush with the circumference of the container 602. While two protrusions are formed here, more may be formed if more auxiliary labels 110 are used, those additional protrusions may be formed in the same manner as 902 and 904. The label 500 is disposed on the container 602, leaving an open area 906, even if the overall length F from FIG. 1 exceeds the circumference of the container 602. The open area 906 may be left blank or may have additional information disposed on it depending upon the contents of the container 602.

While the examples herein discuss an even number of auxiliary labels 110, in the event that an odd number of auxiliary labels 110 are employed, the un-coupled auxiliary label 110 (i.e., the one not used to form a protrusion), may be attached to the container 602, for example, in location 908, in some cases without tearing the micro perforation that may separate it from the second-to-last auxiliary label 110.

FIGS. 9 and 10 are isometric views of a label disposed on a container 602 according to certain embodiments of the present disclosure. FIG. 9 comprises the container 602, a container cap 604, the first protrusion 902 and the second protrusion 904. FIG. 10 illustrates the first and second protrusions 902, 904 from an alternate angle and comprises an area 702 where a prescription number may be located. The first and second protrusions 902, 904 may remain positioned as indicated in FIGS. 9 and 10 where the first protrusion 902 is at about a 90 degree angle with respect to the second protrusion 904. In other embodiments, the first and second protrusions 902, 904, as well as other protrusions, may be laid against the container 602 to be flush or nearly flush with the outer circumferential surface of the container 602.

Figure 11A:
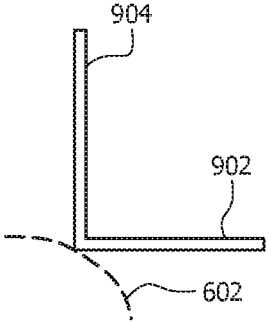
FIGS. 11A-11E are illustrations of configurations of auxiliary labels disposed on a container according to certain embodiments of the present disclosure.
Figure 11B:
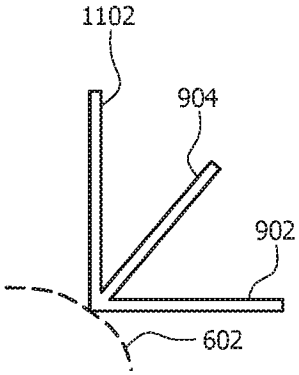

FIGS. 11A-11E are illustrations of configurations of auxiliary labels 110 according to certain embodiments of the present disclosure. While four auxiliary labels 110 are illustrated in FIGS. 1-10, in different embodiments more or less auxiliary labels may be employed. FIG. 11A illustrates the first protrusion 902 and the second protrusion 904 and indicates the outer circumferential surface of the container 602. FIG. 11B is an embodiment where six auxiliary labels are folded in the fan formation to form the first protrusion 902, the second protrusion 904, and a third protrusion 1102. The protrusions described at least in FIGS. 11A-11E are referred to as "first," "second," and "third" to denote embodiments where that is the order in which those protrusions are formed. However, in some embodiments, the protrusions may be formed simultaneously, near-simultaneously (milliseconds apart), or in other orders as appropriate for the container to which the label is applied.

Figure 11C:
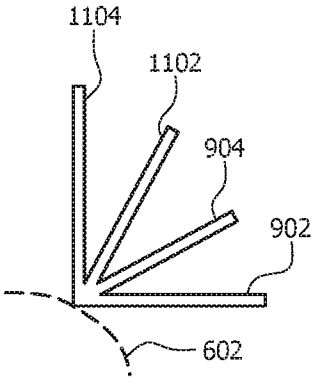
Figure 11D:
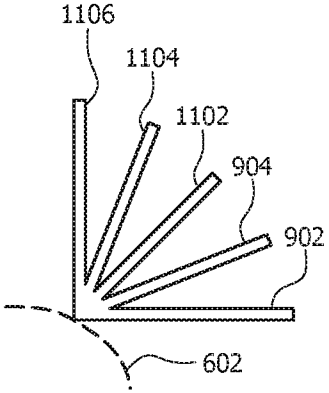
Figure 11E:
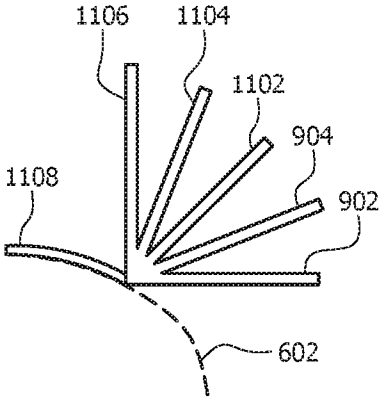

FIG. 11C is an illustration of four protrusions, the first protrusion 902, the second protrusion 904, the third protrusion 1102, and a fourth protrusion 1104. FIGS. 11D and 11E illustrate five protrusions each, the first protrusion 902, the second protrusion 904, the third protrusion 1102, the fourth protrusion 1104, and a fifth protrusion 1106. Each protrusion formed as discussed herein may comprise either two printed auxiliary labels 110 or a printed and an unprinted label so that the protrusion may still be formed. In some embodiments, if there are an odd number of auxiliary labels 110, the auxiliary label 1108 furthest from the primary label 108 may be detached and placed or may be placed while still attached on the outside of the container 602 as illustrated in FIG. 11E.

FIG. 11B illustrates about a 45 degree angle between 902 and 904 and 904 and 1102, FIG. 11C illustrates about a 33 degree angle between each set of protrusions, and FIGS. 11D and 11E illustrate about a 22.5 degree angle between each set of protrusions. However, those angles may vary and the three protrusions in FIG. 11B, for example, are illustrated as such in part for ease of identification but the protrusions may not be fixed in their respective positions after initial folding/formation since the micro perforations at the base of adjoining protrusions may allow for some movement in radial position.

Figure 12A:
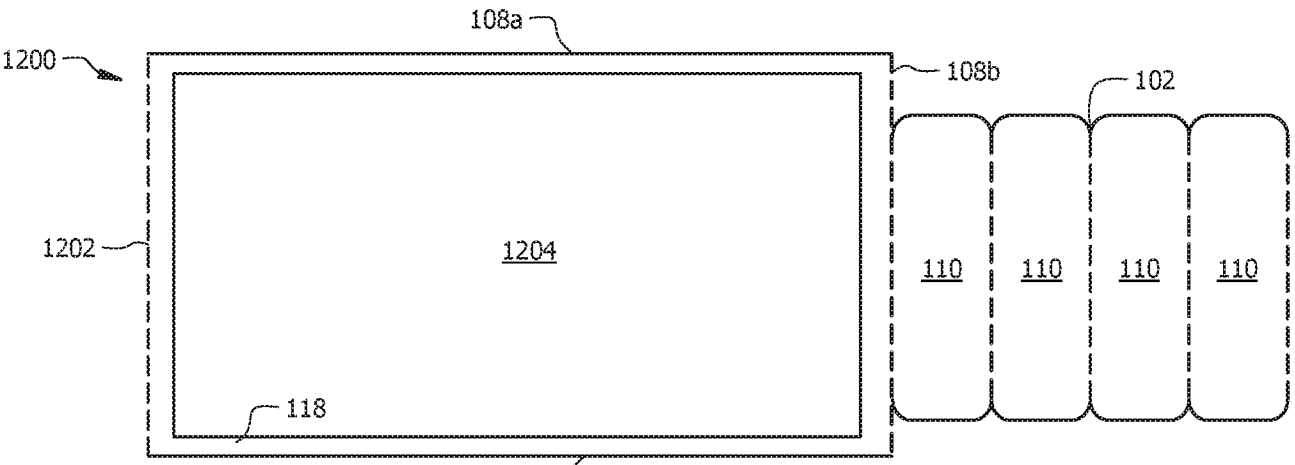
FIGS. 12A and 12B are illustrations of an alternate label configuration according to embodiments of the present disclosure.
Figure 12B:
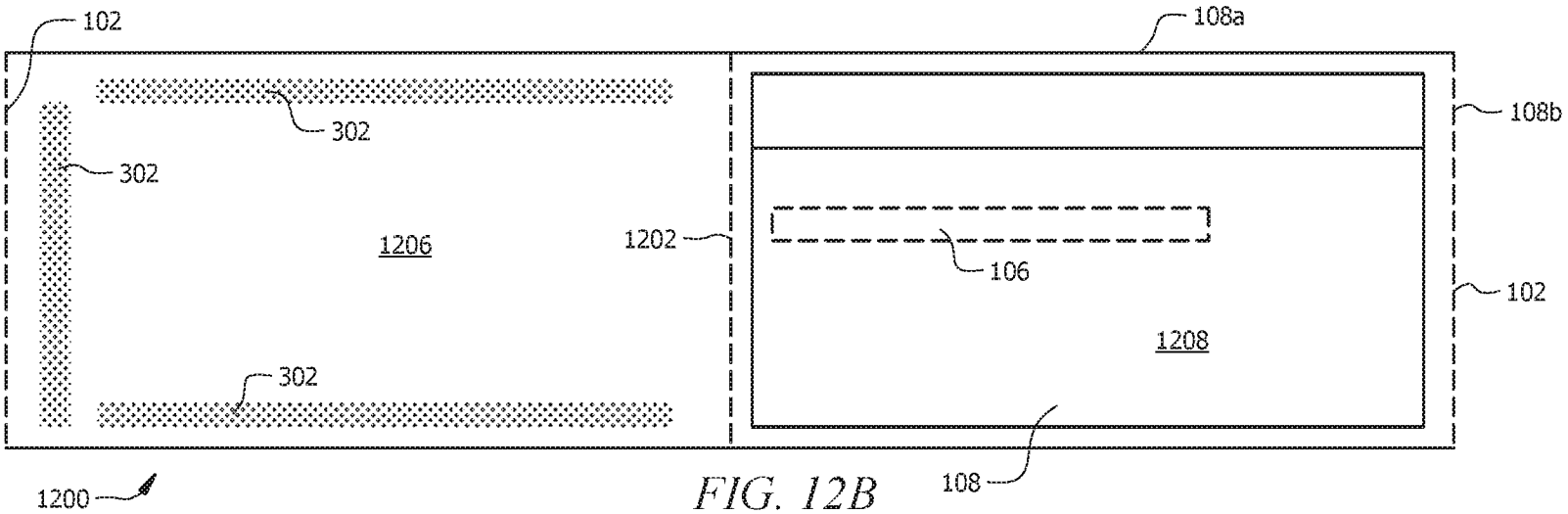

FIGS. 12A and 12B are illustrations of an alternate label configuration according to embodiments of the present disclosure. FIG. 12A is an illustration of label 1200, which is an embodiment of how patient information may be protected by a primary label 108 with a first outer label surface 1204 that folds in on itself in whole or in part along a micro perforation line 1202. FIG. 12B illustrates label 1200 with the primary label portion 108 unfolded to expose a first inner label surface 1206 and a second inner label surface 1208 which may comprise patient information on a removable portion 106. In some embodiments, instead of the removable portion 106, the first outer label surface 1204/first inner label surface 1206 may comprise the patient information and may be removed. In other embodiments, the adhesive 302 may be applied to some or all of the first inner label surface 1206 and/or the second inner label surface 1208 in order to make the primary label 108 resealable. FIG. 12B indicates a plurality of regions where the adhesive 302 may be applied. Depending upon the embodiment, the adhesive 302 may be applied to these regions on the first inner label surface 1206, and/or to corresponding regions on the second inner label surface 1208.

The first outer label surface 1204 may comprise pharmacy information or other information that may not be considered sensitive or confidential by a patient or by health privacy laws. While FIG. 12B illustrates the primary label 108, it is understood that the plurality of auxiliary labels 110 in FIG. 12A are still attached in FIG. 12B. While the fold-out primary portion label 1200 is illustrated in FIGS. 12A and 12B as a fold along a micro perforation line 1202, in other embodiments the fold-out may be a tri-fold, quad-fold, or may partially fold over the primary label 108 to cover patient information but leave other information, for example, pharmacy, prescribing doctor, medicine information, or combinations thereof, visible.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A method of applying a prescription label to a prescription medicine container, wherein the prescription label comprises a primary label and a plurality of auxiliary labels attached to a backing, wherein the primary label includes a first portion connected to a second portion by micro perforations formed in the primary label, wherein the second portion comprises a removable portion, wherein the first portion and the second portion are in a first folded configuration such that i) a first inner label surface of the first portion faces a second inner label surface of the second portion and ii) the first inner label surface covers the removable portion, the method comprising:

removing the primary label and the plurality of auxiliary labels from the backing;

disposing an adhesive side of the second portion of the primary label on an outer surface of the prescription medicine container;

unfolding the first portion and the second portion of the primary label along the micro perforations from the first folded configuration to an unfolded configuration, wherein in the unfolded configuration the removable portion is exposed; and disposing the plurality of auxiliary labels in a second folded configuration, wherein the removable portion is removed after the primary label is disposed on the prescription medicine container.

2. The method of claim 1, wherein an overall length of the prescription label is greater than a perimeter of the prescription medicine container.

3. The method of claim 2, wherein the overall length of the prescription label comprises a length of the primary label and of each of the plurality of auxiliary labels.

4. The method of claim 1, wherein each of the plurality of auxiliary labels comprises a border that separates each auxiliary label from adjacent auxiliary labels.

5. The method of claim 4, wherein adhesive is not disposed in at least some of the borders.

6. The method of claim 4, wherein adhesive is disposed in at least some of the borders but not in an interior space inside of each border.

7. The method of claim 1, wherein the second folded configuration creates a protrusion extending radially from the outer surface of the prescription medicine container.

8. The method of claim 1, wherein the second inner label surface of the second portion of the primary label comprises information that is not patient information.

9. The method of claim 1, wherein each of the plurality of auxiliary labels has a first side opposite of a second side, wherein adhesive is disposed on at least some of the second side of each of the plurality of auxiliary labels.

10. The method of claim 9, wherein the second side of a first auxiliary label of the plurality of auxiliary labels in the second folded configuration is disposed in contact with the second side of a second auxiliary label of the plurality of auxiliary labels in the second folded configuration.

11. The method of claim 1, wherein the primary label and a first auxiliary label of the plurality of auxiliary labels are adjacent and connected by micro perforations.

12. The method of claim 1, wherein the primary label comprises a micro perforated edge containing the micro perforations and three die-cut edges.

13. The method of claim 12, wherein the removable portion is not adjacent to the micro perforated edge and the three die-cut edges of the primary label.

14. The method of claim 1, wherein the removable portion comprises a first end, a second end, and a middle portion between the first end and the second end.

15. The method of claim 14, wherein adhesive is disposed on the middle portion but not on at least one of the first end and the second end.

16. The method of claim 14, wherein adhesive is disposed on at least one of the first end and the second end but not on the middle portion of the primary label.

17. The method of claim 1, wherein the first portion comprises adhesive on the first inner label surface of the first portion, wherein the adhesive does not contact the removable portion when the first inner label surface of the first portion is folded against the second inner label surface of the second portion in the first folded configuration.

18. The method of claim 17, wherein the first portion is not attached to the backing.

19. The method of claim 1, wherein the removable portion comprises patient information.

* * * * *